US009394679B2

(12) United States Patent
Tanaka et al.

(10) Patent No.: US 9,394,679 B2
(45) Date of Patent: Jul. 19, 2016

(54) CONNECTION STRUCTURE OF BEAM AND COLUMN, AND CONNECTION MEMBER

(75) Inventors: Hidenori Tanaka, Tokyo (JP); Michio Itoh, Tokyo (JP); Hideaki Takahashi, Tokyo (JP); Takumi Niida, Tokyo (JP)

(73) Assignee: SENQCIA CORPORATION, Tokyo (JP)

( * ) Notice: Subject to any disclaimer, the term of this patent is extended or adjusted under 35 U.S.C. 154(b) by 0 days.

(21) Appl. No.: 14/344,057

(22) PCT Filed: Sep. 13, 2012

(86) PCT No.: PCT/JP2012/073411

§ 371 (c)(1),
(2), (4) Date: Apr. 15, 2014

(87) PCT Pub. No.: WO2013/039128

PCT Pub. Date: Mar. 21, 2013

(65) Prior Publication Data

US 2014/0338280 A1 Nov. 20, 2014

(30) Foreign Application Priority Data

Sep. 14, 2011 (JP) ..... 2011-200382
Mar. 6, 2012 (JP) ..... 2012-049017

(51) Int. Cl.
*E04B 1/19* (2006.01)
*E04B 1/24* (2006.01)
(Continued)

(52) U.S. Cl.
CPC ..... *E04B 1/1903* (2013.01); *E04B 1/185* (2013.01); *E04B 1/2403* (2013.01); *E04B 2001/1957* (2013.01); *E04B 2001/2445* (2013.01); *E04B 2001/2454* (2013.01)

(58) Field of Classification Search
CPC ..... E04B 1/40; E04B 2/76; E04B 2/762; E04B 2001/405; E04C 3/30; E04C 3/32; F16B 12/50
USPC ..... 52/650.1, 653.1, 653.2, 655.1, 656.9
See application file for complete search history.

(56) References Cited

U.S. PATENT DOCUMENTS 4,128,064 A * 12/1978 Chung ..... A47B 57/265 108/147.13
4,445,307 A * 5/1984 Puccinelli ..... E04G 7/307 182/186.7

(Continued)

FOREIGN PATENT DOCUMENTS

JP 10-106320 A 4/1998
JP 2001329613 A 11/2001

(Continued)

OTHER PUBLICATIONS

International Search Report for PCT/JP2012/073411 mailed Oct. 30, 2012.

(Continued)

*Primary Examiner* — Phia A
(74) *Attorney, Agent, or Firm* — Hauptman Ham, LLP

(57) ABSTRACT

In a beam-connection member 9, the bottom surface side is a column-connection surface 14 and one side surface is a beam-mounting surface 16. In other words, the column-connection surface 14 and the beam-mounting surface 16 are formed to be substantially perpendicular. The column-connection surface 14 is the site of connection with a surface of the column. A depression 15 is formed on the column-connection surface 14. The depth of the depression 15 is preferably at least half of the main body thickness of the beam-connection member 9. Further, a notch 11 is formed across the width direction on the column-connection surface 14. The notch 11 is to avoid interference with the diaphragm. Near the notch 11, a rib 17 is provided in the depression 15 as necessary in the width direction. The rib 17 is for preventing deformation of the beam-connection member and for reinforcing the beam-connection member.

8 Claims, 10 Drawing Sheets

(51) Int. Cl.
*E04B 2/76* (2006.01)
*E04B 1/18* (2006.01)

(56) References Cited

U.S. PATENT DOCUMENTS

| | | | | | |
|---|---|---|---|---|---|
| 5,354,025 | A * | 10/1994 | McCaffrey | A47B 96/06 | 108/156 |
| 5,438,811 | A * | 8/1995 | Goya | 52/702 | |
| 5,575,580 | A * | 11/1996 | Parrish | E04H 17/1413 | 248/219.4 |
| 5,660,017 | A * | 8/1997 | Houghton | 52/655.1 | |
| 5,727,358 | A * | 3/1998 | Hayashi et al. | 52/745.2 | |
| 5,785,447 | A * | 7/1998 | Fonti | E04H 17/1413 | 248/219.4 |
| 6,068,143 | A * | 5/2000 | Wang | A47B 57/265 | 108/144.11 |
| 7,515,673 | B2 * | 4/2009 | Jensen | G21C 19/02 | 376/302 |
| 7,530,540 | B2 * | 5/2009 | Long et al. | 248/230.1 | |
| 7,559,180 | B2 * | 7/2009 | Ajiki | 52/655.1 | |
| 7,637,069 | B2 * | 12/2009 | Iri et al. | 52/655.1 | |
| 7,637,076 | B2 * | 12/2009 | Vaughn | E02D 27/34 | 403/169 |
| 7,762,038 | B2 * | 7/2010 | Ceba et al. | 52/653.1 | |
| 7,874,120 | B2 * | 1/2011 | Ohata et al. | 52/655.1 | |
| 8,870,136 | B2 * | 10/2014 | Ellingboe | A63G 31/00 | 248/219.4 |
| 8,961,060 | B2 * | 2/2015 | Oetlinger | 403/259 | |
| 2011/0047925 | A1 * | 3/2011 | Gan | 52/653.1 | |
| 2011/0107711 | A1 * | 5/2011 | Foley | 52/655.1 | |

FOREIGN PATENT DOCUMENTS

| | | | |
|---|---|---|---|
| JP | 2002356910 | A | 12/2002 |
| JP | 2008121419 | A | 5/2008 |

OTHER PUBLICATIONS

Office Action mailed Sep. 8, 2015, corresponding to Japanese patent application No. 2012-049017.

* cited by examiner (a)

(b)

(a)

(b)

(a)

(b)

(a)

(b)

(a)

(b)

CONNECTION STRUCTURE OF BEAM AND COLUMN, AND CONNECTION MEMBER

RELATED APPLICATIONS

The present application is a National Phase of International Application Number PCT/JP2012/073411, filed Sep. 13, 2012, and claims priority from, Japanese Application Number 2011-200382, filed Sep. 14, 2011 and Japanese Application Number 2012-049017, filed Mar. 6, 2012.

FIELD OF THE INVENTION

The present invention relates to a connection structure of a beam and a column and the like for connecting a beam having different heights to a steel pipe column.

BACKGROUND OF THE INVENTION

Conventionally, in a construction using a steel pipe column, there is a case in which a beam of H shaped steel is connected. To connect the column and the beam, a through-diaphragm corresponding to the height of a flange part of the beam is provided to transmit stress from the beam to the column efficiently at a connection part thereof. The through-diaphragm is a plate-like member that is connected by welding and the like between a column and a column. Generally, the flange part of the beam is butted against the side surface of the through-diaphragm and welded.

However, there are cases in which the sizes (heights) of the beam that is connected to the column are not same in all directions. For example, there is a case in which a beam having a shorter height in one direction is connected. In such a case, it is impossible to connect at least one of the upper and lower flanges of the beam to the through-diaphragm to which another beam is connected.

To connect such a beam having different heights, a connection structure of column-and-beam wherein, a square-shaped section pipe, a cross-shaped plate that supports two parallel sides of the square-shaped section pipe, and a tilted plate that supports two sides holding a corner part of the square-shaped section pipe are integrally formed by casting; an edge part of a column-and-beam connection metal is welded to the square-shaped section pipe, the column-and-beam connection metal having peripheral surface which are flat shaped at least at the area on which the beam is attached; and an H shape beam is connected by non-scallop welding to the peripheral surface of the column-and-beam connection metal is proposed (See Patent Document 1).

PRIOR ART DOCUMENT

Patent Document

[Patent Document 1] Japanese Unexamined Patent Application Publication No. 2001-329613

SUMMARY OF THE INVENTION

Problems to be Solved by the Invention

However, providing an inner diaphragm in the column such as in Patent Document 1 requires a large amount of welding and has a problem of poor workability. Also, in the structure described in Patent Document 1, since it is necessary to integrally mold the column-and-beam connection structure, the metal object becomes large in mass and costly as well. However, providing the through-diaphragm for each of the beams with different heights requires man-hours since it is necessary to cut the column, hold the column in between by the diaphragms, and then connect the column and the diaphragms.

The present invention was achieved in view of such problems. Its object is to provide a connection structure of a beam and a column, wherein the beam having different heights is connected to the column without connection members such as diaphragms and the like inside the column, so that the structure is simple and the work can be done only outside the column.

Means for Solving Problems

To achieve the above object, a first invention provides a structure of a beam and a column comprising: a connection member having a column-connection surface connected to the column, a beam-mounting surface which is a surface approximately perpendicular to the column-connection surface, and a notch formed on the column-connection surface along the width direction of the body to avoid interference with a diaphragm; a pair of diaphragms formed on the column; a first beam of which flange parts are connected to the upper and the lower diaphragms respectively; and a second beam that has a different height to the first beam and is connected to the column in a different direction to the first beam; wherein, the thickness of the connection member at an intersection part of the extended part of the diaphragm and the connection member, in which the interference is avoided at the notch, is provided to be larger than the thickness of the column; a flange part of the second beam is connected to one of the diaphragms; the column-connection surface of the connection member is connected to the peripheral surface of the column between the other flange part of the second beam and the other diaphragm; and stress is transmitted between the other flange part of the second beam and the other diaphragm via the connection member.

It is preferable that a depression is provided on the beam-connection surface and the depth of the depression is half or more of the body thickness of the connection member. It is also preferable that the thickness of the connection member at an intersection part of the extended part of the diaphragm and the connection member, in which the interference is avoided at the notch, is provided to be larger than the thickness of the column. Preferably, the lower surface of the other flange surface of the second beam is in contact with the beam-mounting surface of the connection member. A rib may be formed on the depression in its width direction.

It is also preferable to use a reinforcing member having a convex part protruding along the thickness direction of the edge part of the body in a direction that is perpendicular to its width direction wherein, the column has an approximately rectangular shaped cross-sectional outline and a curved surface part at a corner part; at least one of the edge part of the second beam in its width direction protrudes over the curved surface part of the column; the reinforcing member is connected to the column and the second beam with the convex part being inserted to a gap between the curved surface part and the other flange part of the second beam at the height of the other flange part of the second beam; and stress is transmitted between the other flange part of the second beam and the column via the reinforcing member.

It is preferable that the beam-and-column connection member comprises a column-connection surface which is connected to the column and a beam-mounting surface which is a surface approximately perpendicular to the column-connection surface. It is also preferable to further use a connection member having a notch formed along the width direction of the body to avoid interference with a diaphragm provided with a depression having a depth which is half or more of the thickness of the connection member on the column-connection surface wherein, the column-connection surface of the connection member is connected to the peripheral surface of the column between the other flange part of the second beam and the other diaphragm; and stress is transmitted between the other flange part of the second beam and the other diaphragm via the connection member.

The width of the second beam may be less than the width of the column and the second beam may be connected to the column decentered in its width direction.

It is preferable that the inner surface of the convex part of the reinforcing member is a concave curved surface part which approximately corresponds to the shape of the curved surface, and the radius of curvature of the concave surface part is less than the radius of curvature of the curved surface part.

It is preferable that the length of the reinforcing member is half or less of the width of the column.

According to the first aspect of the present invention, since the depression is formed on the welded surface side that is to be connected to the column, and the depth of the depression is half or more of the body thickness, weight-reduction is achieved without having excessive strength. For example, when force is applied in a direction in which the beam moves away from the column, the column takes charge of the tensile force and the connection member takes charge of the compressive force. In this situation, the compressive force is received by the outer side of the thickness center of the connection member.

That is, excessive strength is not required for this part since the inner side of the thickness center of the connection member does not take charge of the force from the beam and the column takes charge of the tensile force. Therefore, both high strength and weight-reduction can be achieved by forming a depression on this part.

Also, if the connection member is welded to the diaphragm and the outer surface of the column, and if the lower part of the flange part of the beam is in contact with the beam-mounting surface of the connection member, stress from the beam can be securely transmitted to the column.

Also, if the rib is formed in the depression in its width direction, a deformation and the like of the connection member can be avoided when force is applied from the beam to the column.

On the other hand, in a case in which the column is a rectangular steel pipe, the column is made by bending a steel plate and a curved surface part is formed on the corner part. Therefore, for example, to weld the beam to the column such that the beam is decentered to the column and the side surface of the column can coincide with the side surface of the beam, it is required to weld the beam to the curved surface part of the column. However, since a gap is formed between the beam and the curved surface part, it is necessary to form a through-diaphragm at the part to effectively transmit stress from the beam to the column. However, as described above, disposing a through-diaphragm at each beam height requires large amount of work time and is not preferable.

In comparison to above, according to the present invention, a connection structure of the column and the beam which can transmit stress from the beam to the column effectively even for the column having the curved surface part on the corner part can be obtained. More specifically, when connecting a beam having different heights from other beams to a column and a part of the beam protrudes over the curved surface part of the column, stress from the beam to the column at the part can be effectively transmitted by using a reinforcing member having a convex part and welding the convex part which is disposed in a gap between the column and the beam at the curved surface part.

Such a structure is especially effective in a case in which the beam is smaller in width than the column and is disposed decentered to the column in its width direction.

Also, by making the shape of the side surface of the convex part a concave surface part that approximately corresponds to the shape of the curved surface part of the corner of the column and by making the radius of curvature of the concave curved surface part smaller than the radius of curvature of the curved surface part of the column, the reinforcing member does not come off from the welding surface of the column.

Also, by making the length of the reinforcing member half or less than the width of the column, it is possible to use two reinforcing members simultaneously arranged in the width direction at an approximately same height. Therefore, even when each pf the beams connected on both opposing sides of the column is decentered toward one direction and protruding over the curved surface part, reinforcing members can be used for each of the beams.

The second aspect of the present invention provides a beam-and-column connection member comprising: a column-connection surface which is connected to the column; a beam-mounting surface which is a surface approximately perpendicular to the column-connection surface; a notch formed on the column-connection surface along the width direction of the body to avoid interference with a diaphragm; wherein, a depression having a depth which is half or more of the thickness of the connection member is formed on the column-connection surface.

According to the second aspect, it is possible to obtain a lightweight beam-connection member which can be used at a connection part of the column and the beams having different heights, and can transmit stress from the beam to the column effectively.

Effect of the Invention

According to the present invention, the present invention can provide a connection structure of a beam and a column, wherein the beam having different heights is connected to the column without having connection members such as diaphragms and the like inside the column, so that the structure is simple and the work can be done only outside the column.

BRIEF DESCRIPTION OF DRAWINGS

FIG. 4(*b*) is a cross sectional view of C-C line in FIG. 4(*a*).

FIG. 9(*b*) is an enlarged view showing the I part in FIG. 9(*a*).

DETAILED DESCRIPTION OF THE PREFERRED EMBODIMENTS

Figure 1:
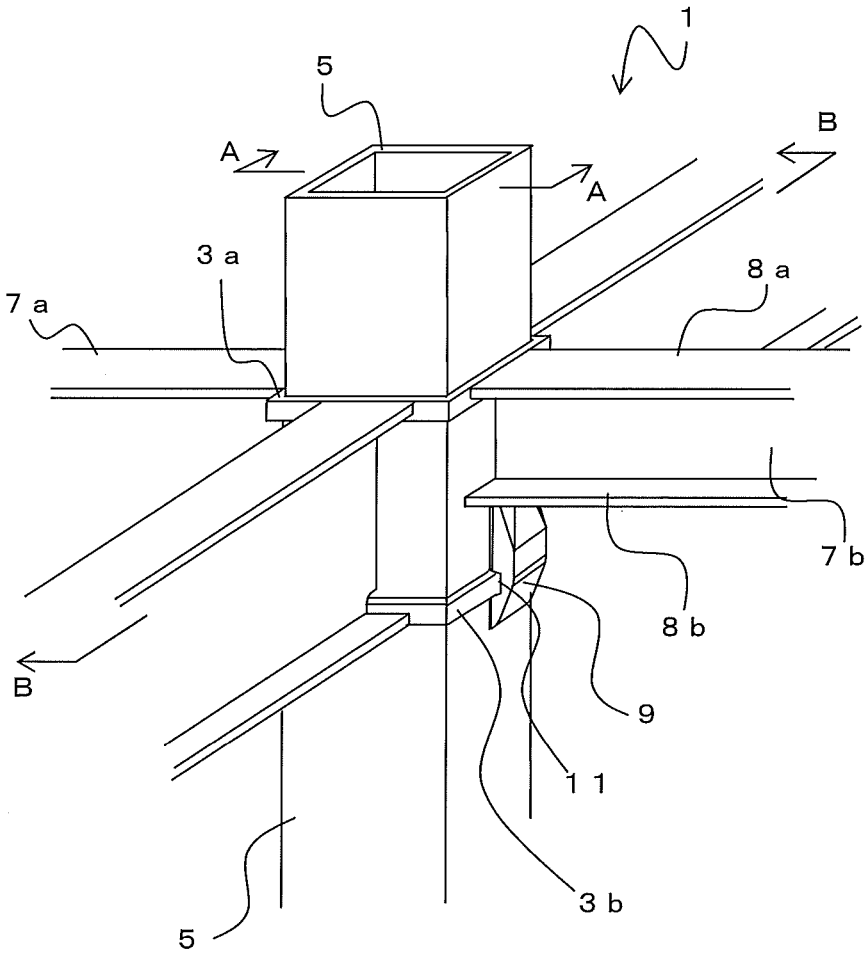
FIG. 1 is a perspective view showing a column-and-beam connection structure 1.

Hereinafter, a column-and-beam connection structure in accordance with the embodiments of the present invention will be described. FIG. 1 is a perspective view of the column-and-beam connection structure 1. The column-and-beam connection structure 1 is a structure having a plurality of beams 7*a* and 7*b* that are connected to a column 5.

The column 5 is a hollow, square shaped steel pipe and the beams 7*a*, 7*b* are H shaped steel. The beam 7*a* and 7*b* are different in height. Although an example of a structure having the beam 7*a* formed in three directions of the column 5 and the beam 7*b* formed in one direction is shown in FIG. 1, the structure is not limited to this in the present invention and the beam 7*b* may be provided in a plurality of directions.

A pair of diaphragms 3*a*, 3*b* is connected to the column 5. The diaphragms 3*a*, 3*b* are through-diaphragms protruding outwardly from the column 5. The diaphragms 3*a*, 3*b* are provided on the column 5 at upper and lower parts with a predetermined distance in between.

Edge parts of upper and lower flange parts of the beam 7*a* are connected to the diaphragm 3*a*, 3*b* respectively by welding. That is, the distance of placement of the diaphragm 3*a*, 3*b* coincides with the distance between the flange parts of the beam 7*a*. Therefore, stress from the beam 7*a* can be securely transmitted to the column.

The edge part of an upper flange part 8*a* of the beam 7*b* is connected to the upper diaphragm 3*a* by welding. Since the beam 7*b* is shorter in height than the beam 7*a*, a gap is generated between the lower flange part 8*b* of the beam 7*b* and the diaphragm 3*b*.

In the present invention, a beam-connection member 9 is connected between the diaphragm 3*b* and the flange part 8*b* of the beam 7*b*. That is, the flange part 8*b* of the beam 7*b* and the diaphragm 3*b* are connected via the beam-connection member 9. Therefore, stress from the beam 7*b* can be securely transmitted.

Figure 2:
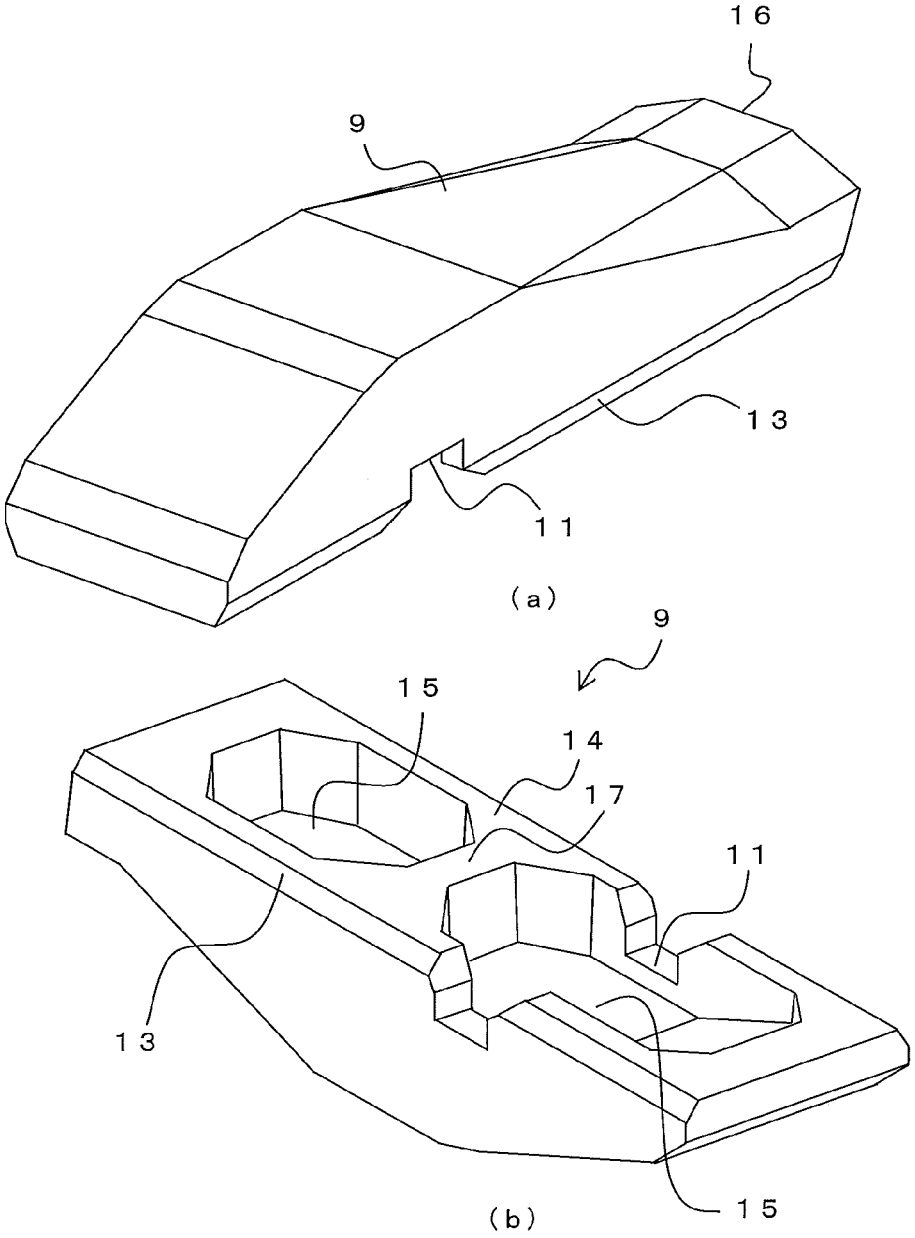
FIG. 2(*a*) and FIG. 2(*b*) are perspective views illustrating a beam-connection member 9 in which FIG. 2(*a*) is a perspective view of the top surface and FIG. 2(*b*) is a perspective view of the bottom surface.

FIG. 2(*a*) and FIG. 2(*b*) are perspective views illustrating a beam-connection member 9 in which FIG. 2(*a*) is a perspective view of the top surface and FIG. 2(*b*) is a perspective view of the bottom surface. In the beam-connection member 9, the bottom surface side is the column-connection surface 14, and one of the side surfaces is a beam-mounting surface 16. That is, the column-connection surface 14 and the beam-mounting surface 16 are formed approximately vertical to each other.

The column-connection surface 14 is a part which is connected to the surface of the column. A depression 15 is formed in the column-connection surface 14. The depth of the depression 15 is preferably half or more of the body thickness of the beam-connection member 9.

Also, a notch 11 is formed in the column-connection surface 14 in its width direction. The notch 11 avoids interference with the diaphragms. If necessary, a rib 17 is provided in the depression 15 in its width direction in a vicinity of the notch 11. The edge surface of the rib 17 may be the same surface as the column-connection surface 14, or the height of the rib 17 may be less than the depths of the depression 15. The rib 17 prevents the beam-connection member from deformation and reinforces the beam-connection member.

A tapered part 13 is provided at an edge part between each side surface and the column-connection surface of the beam-connection member 9. The tapered part 13 indicates a welding margin for the beam-connection member 9 and the column 5. If the welding margin is too small, a welding strength cannot be ensured. If the welding margin is too large, distortion of the beam-connection member and the like becomes larger and excessive costs are required. Therefore, the tapered part 13 is formed to indicate an appropriate welding margin.

The beam-connection member 9 is formed such that its thickness is at maximum at the notch 11 and gradually decreases toward both edges. The shape of the beam-connection member 9 is not limited to the illustrated example. The shape of the depression 15, the external shape of the beam-connection member 9, and the like are provided appropriately as long as the above-mentioned structure is maintained.

Figure 3:
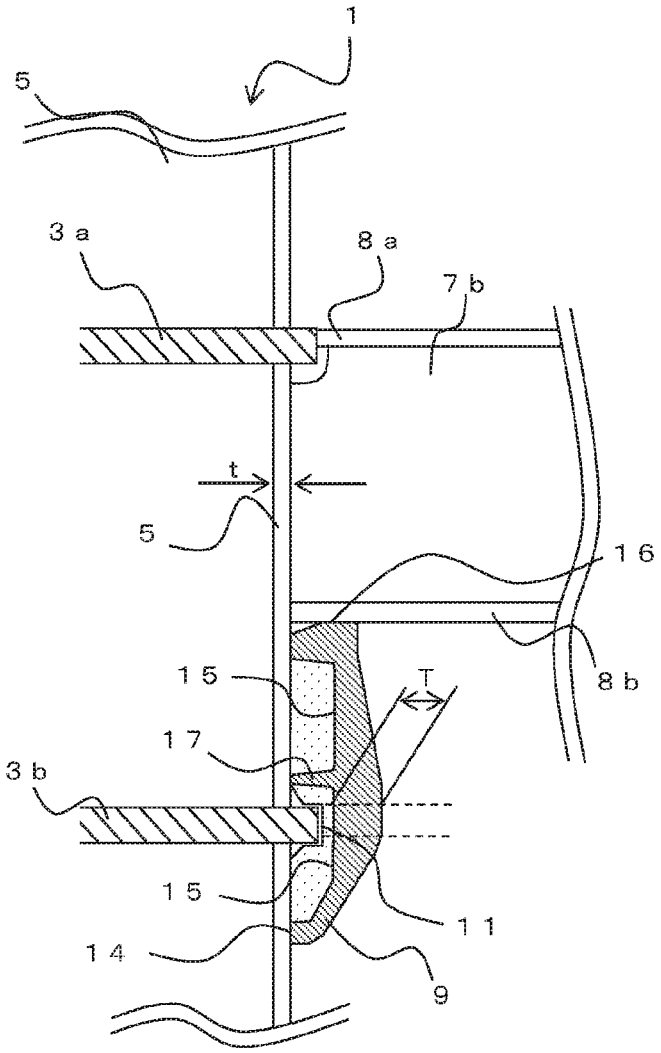
FIG. 3 is an elevation view of the column-and-beam connection structure 1 and a cross sectional view of A-A line in FIG. 1.

FIG. 3 shows the column-and-beam structure 1 and is a cross sectional view of A-A line in FIG. 1. Similarly, FIG. 4(*a*) is a cross sectional view of B-B line in FIG. 1.

As shown in FIG. 3, the beam-connection member 9 is connected to the column 5 such that the upper surface (the beam-mounting surface 16) is in contact with the lower surface of the flange part 8*b* of the beam 7*b*. That is, the beam-connection member 9 is fixed to fill the gap between the upper surface of the protrusion of the diaphragm 3*b*, which is a through-diaphragm, and the lower surface of the beam 7*b*.

The contact surface of the lower surface of the flange part 8*b* of the beam 7*b* and the beam-mounting surface 16 is not necessarily be welded, and, in such cases, the lower surface of the flange part 8*b* and the beam-mounting surface 16 may not be in contact.

As mentioned above, the notch 11 is formed onto a part corresponding to the connection part of the beam-connection member 9 and the diaphragm 3. Therefore, the beam-connection member 9 and the diaphragm 3*b* do not interfere each other. The lower edge of the beam-connection member 9 is located below the diaphragm 3*b*. That is, the beam-connection member 9 straddles the diaphragm 3*b* and is connected to the peripheral surface of the column 5.

The beam-connection member 9 and the column 5 are connected at the above-mentioned tapered part with a welded part 19. The contact surface of the lower surface of the flange part 8*b* of the beam 7*b* and the beam-mounting surface 16 is not necessarily be welded.

In FIG. 3, the upper flange part 8*a* of the beam 7*b* may be welded to the diaphragm 3*a*, the web part of the beam 7*b* and the edge part of the flange part 8*b* may be welded to the peripheral surface of the column 5, and the beam-connection member 9 may be welded to the column 5 and the diaphragm 3*b* at contacting parts respectively. However, the beam-connection member 9 has to be welded to the peripheral surface of the column 5 and it is not necessary to weld the beam-connection member 9 to the diaphragm 3*b*. In this case, the notch 11 is made larger and a gap may be formed between the beam-connection member 9 and the diaphragm 3*b*.

T is the thickness of the beam-connection member 9 at the intersection part of the extended part of the diaphragm 3*b* (the extended part in the direction which is perpendicular to the vertical direction of the column to which the beam-and-column connection member 9 is connected) and the connection member 9 (the thickness of the bottom surface of the corresponding part of the depression 15). T is provided such that T is larger than t which is the thickness of the column 5. That is, the depth of the depression 15 is equal to or more than half of the overall body thickness of the beam-connection member 9 and T is provided to be larger than t.

As described above, providing the beam-connection member 9 between the diaphragm 3*b* and the beam 7*b* enables downward stress from the beam 7*b*, moment originating from the connection part with the diaphragm 3*a*, and the like to securely transmit to the column 5.

Figure 4:
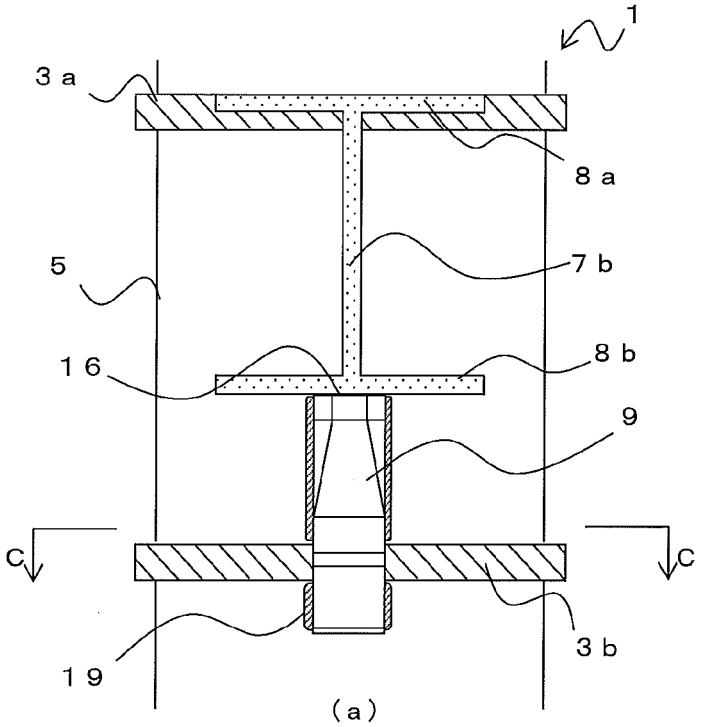
FIG. 4(*a*) is an elevation view of the column-and-beam connection structure 1 and a cross sectional view of B-B line in FIG. 1.
Figure 4:
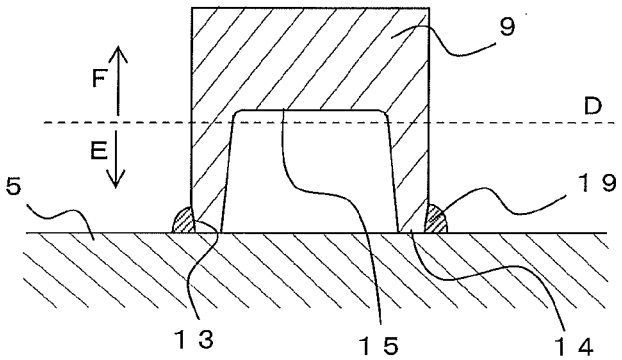

FIG. 4(*b*) is a cross sectional view of C-C line in FIG. 4(*a*). As mentioned above, the beam-connection member 9 is welded to the column 5 at the tapered part 13. In this condition, if force is added from the beam to the column, force is also applied to the beam-connection member 9.

For example, in FIG. 3, if force is applied in the direction in which the beam 7*b* moves away from the column 5 (to the right in the drawing), tensile force is applied on the inner side (E in the drawing) of the center of the thickness direction of the beam-connection member 9 (D in the drawing). Also, compressive force is applied on the outer side (F in the drawing) of the center of the thickness direction of the beam-connection member 9 (D in the drawing).

In this case, since the column 5 can carry the tensile force, excessive strength is unnecessary on the inner side E of the center D of the beam-connection member 9. On the other hand, on the outer side F of the center D of the beam-connection member 9, higher strength is required since the compressive fore is carried only by the beam-connection member 9.

The beam-connection member 9 in accordance with the present invention has a depression 15 formed for thickening the part (F) in which high strength is required and thinning the part (E) in which less strength is needed. That is, when connected to the column, by thickening the part which is distant from the connection surface of the column 5, reinforcement is conducted efficiently and weight reduction can be achieved by the depression 15 as well. Especially, by thickening the part which is distant from the column, the column is reinforced and its bearing force can be improved in its out-of-plane direction.

The beam-connection member 9 may not necessarily be provided at the lower part of the beam 7*b*, and may be provided at the upper part. In this case, the beam 7*b* and the beam-connection member 9 may be connected in a vertically inverted position of FIG. 2 and FIG. 3. In this case, the contact surface between the bottom plate of the beam-connection member 9 and the beam 7*b* is required to be connected by welding and the like.

As described above, according to the embodiment of the present invention, in a case in which the beam 7*b* having different heights is to be connected to the column 5, it is not necessary to provide inner diaphragms in the column 5, and there is no need to connect a special connection metal to a part of the column. Therefore, the workability of connecting the beam and the column is excellent.

Also, it is low cost since common steel materials can be used for the beam-connection member 9. Also, the force in the perpendicular direction and the moment from the beam 7*b* can be securely received by the beam-connection member since the column 5 and the beam 7*b* are connected with the beam-connection member which securely fills the gap between the upper surface (or the lower surface) of the protruded part of the through-diaphragm and the lower surface (or the upper surface) of the beam 7*b*. Therefore, the stress from the beam 7*b* can be transmitted to the column 5 securely within a simple structure.

Also, the beam-connection member 9 is light in weight since the depression 15 is formed on the side of the column-mounting surface, and, also, reinforcement can be done efficiently because the part that especially requires strength is thickened.

The tapered part 13 is not necessarily be in a tapered form, but may be a stepped part or a mark-off line as long as the welding margin is visibly recognizable.

Figure 5:
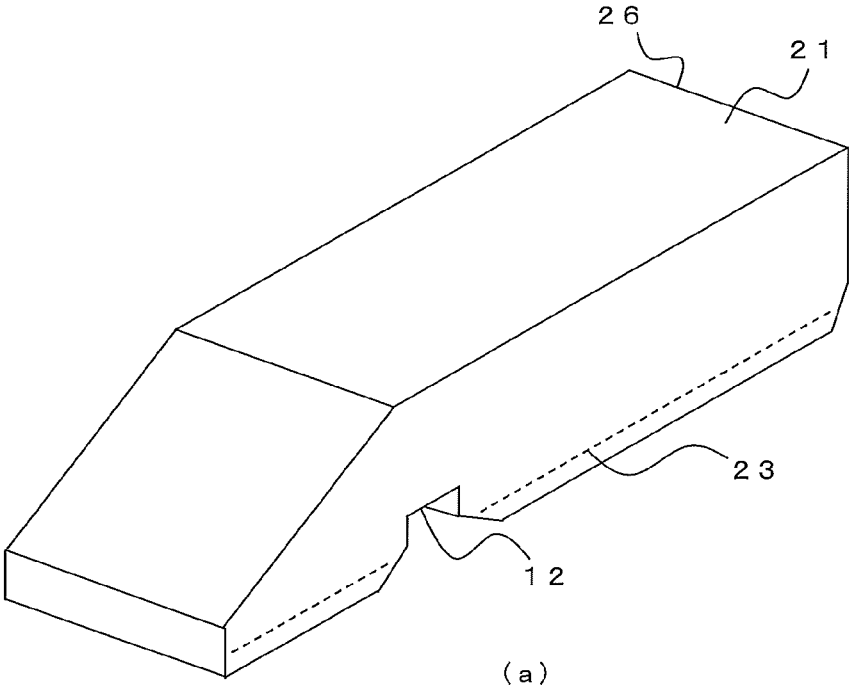
FIG. 5(*a*) and FIG. 5(*b*) are perspective views illustrating a beam-connection member 21 in which FIG. 5(*a*) is a perspective view of the top surface and FIG. 5(*b*) is a perspective view of the bottom surface.
Figure 5:
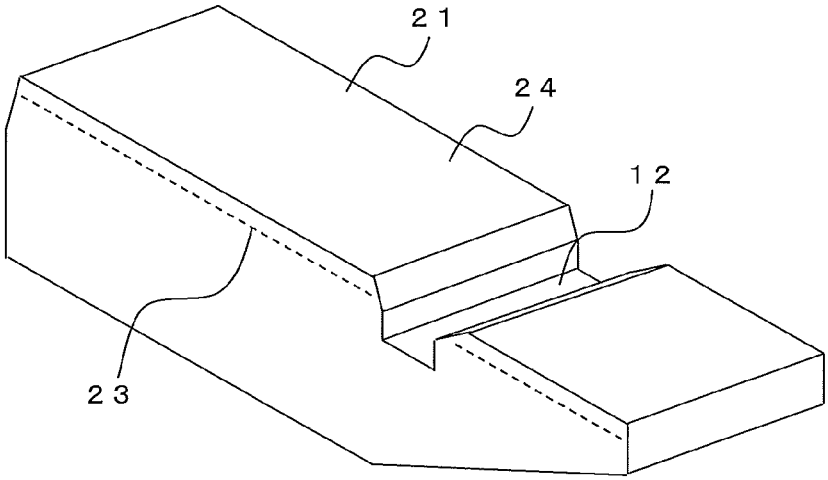

Also, although the depression is formed on the column-connection surface in the embodiment described above, the depression is not always necessary. FIG. 5s are perspective views illustrating a beam-connection member 21 that does not have a depression. FIG. 5(*a*) is a perspective view of the top surface and FIG. 5(*b*) is a perspective view of the bottom surface. In the beam-connection member 21, the bottom surface side is the column-connection surface 24, and the other side is a beam-mounting surface 26. That is, the column-connection surface 24 and the beam-mounting surface 26 are formed approximately vertical to each other. The column-connection surface 24 is a part that is to be connected to the column-connection surface. A notch 12 is formed on the column-connection surface 24 across the width direction. The notch 12 avoids interference with the diaphragm.

A mark-off line 23 is provided at a vicinity of the edge part between both sides of the beam-connection member 21 and the column-connection surface 24 as necessary. The mark-off line 23 is for specifying the welding range of the beam-connection member 21 and the column 5, and has the same function as the tapered part 13.

Figure 6:
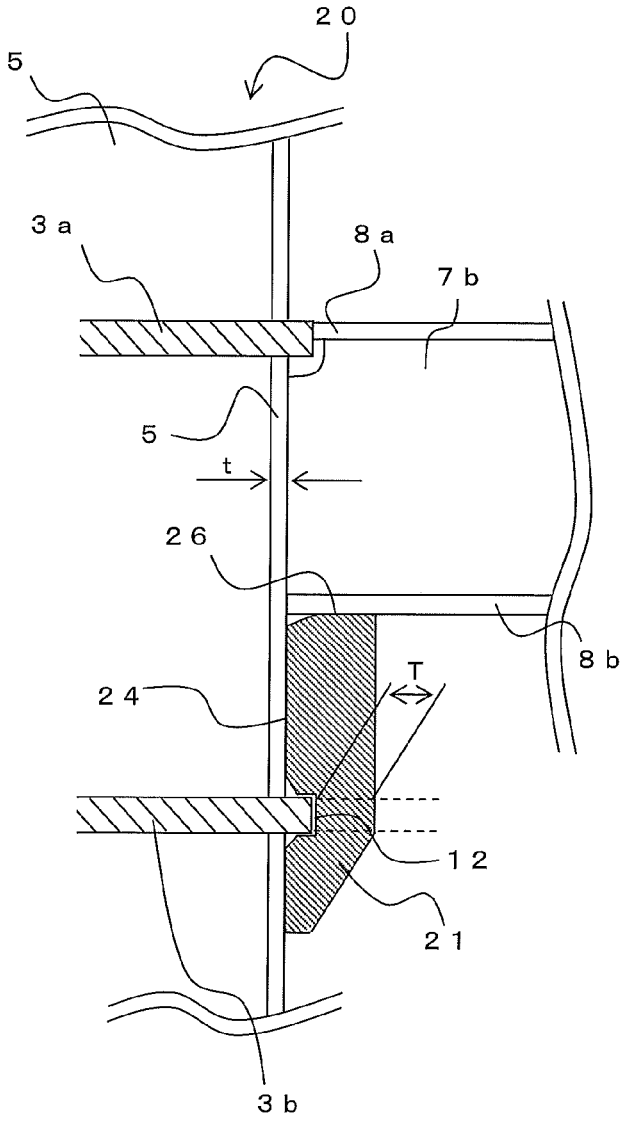
FIG. 6 is an elevation view illustrating a column-and-beam connection structure 20.

FIG. 6 shows a column-and-beam connection structure 20. As shown in FIG. 6, the beam-connection member 21 is connected to the column 5 such that the upper surface (beam-mounting surface 26) makes contact with the lower surface of the flange part 8*b* of the beam 7*b*. That is, the beam-connection member 21 is fixed so to fill the gap between the upper surface of the protruded part of the through-diaphragm 3*b* and the lower part of the beam 7*b*.

As described above, the notch 12 is formed on the part that corresponds to the connection part of the beam-connection member 21 and the diaphragm 3*b*. Therefore, the beam-connection member 21 and the diaphragm 3*b* do not interfere. The lower edge of the beam-connection member 21 is located below the diaphragm 3*b*. That is, the beam-connection member 21 is connected to the peripheral surface of the column 5 straddling the diaphragm 3*b*.

Also, in FIG. 6, the upper flange part 8*a* of the beam 7*b* may be welded to the diaphragm 3*a*, the web part of the beam 7*b* and the edge part of the flange part 8*b* may be welded to the peripheral surface of the column 5, and the beam-connection member 21 may be welded to the column 5 and the diaphragm 3*b* at contacting parts respectively. However, the beam-connection member 21 has to be welded to the peripheral surface of the column 5 and it is not necessary to weld the beam-connection member 21 to the diaphragm 3*b*. In this case, the notch 12 is made larger and a gap may be formed between the beam-connection member 21 and the diaphragm 3*b*.

T is the thickness of the beam-connection member 21 at the intersection part of the extended part of the diaphragm 3*b* (the extended part in the direction which is perpendicular to the vertical direction of the column to which the beam-and-column connection member 21 is connected) and the connection member 21 (the thickness of the bottom surface of the corresponding part of the depression 15). T is provided such that T is larger than t, which is the thickness of the column 5.

In this way, by using the beam-connection member 21, which does not have a depression part, a similar effect can be obtained as the beam-connection member 9.

Figure 7:
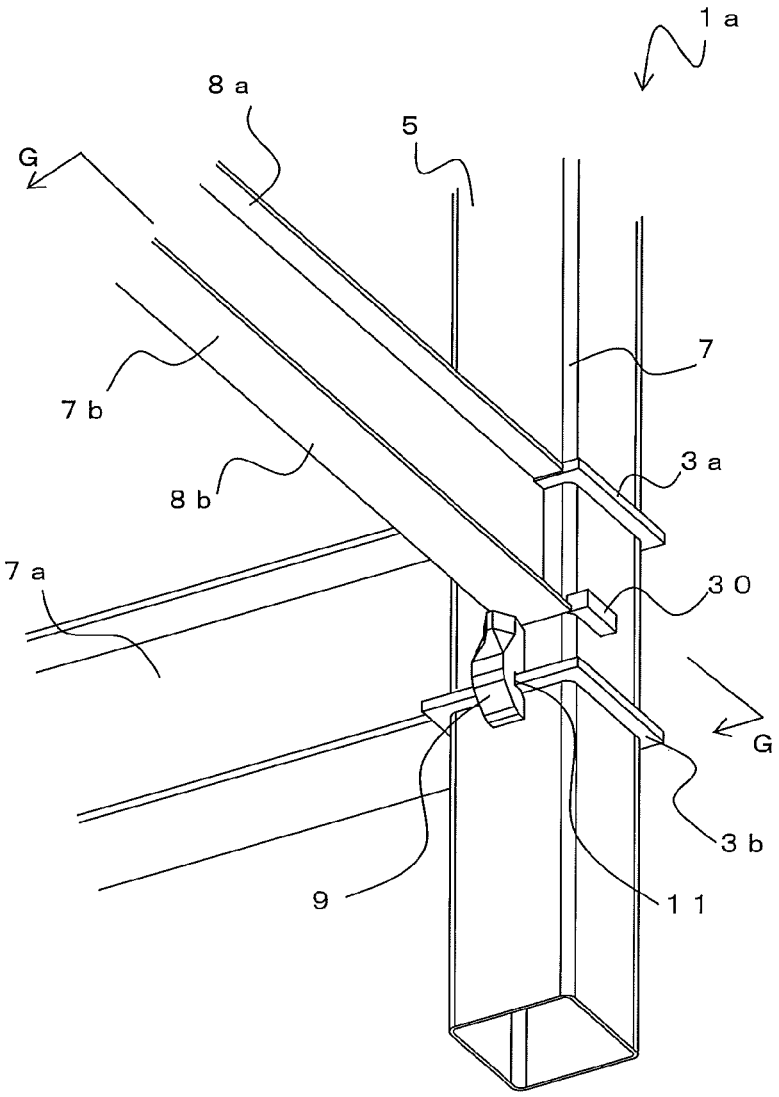
FIG. 7 is a perspective view illustrating a column-and-beam connection structure 1*a*.

Next, a column-and-beam connection structure 1*a* will be described according to a second embodiment. Hereinafter, same numerals as in FIG. 1 and the like will be used for the components which have the same functions as in the column-and-beam-connection structure 1 and redundant explanations will be omitted. FIG. 7 is a perspective view illustrating the column-and-beam connection structure 1*a*. The column-and-beam connection structure 1*a* is a structure in which a plurality of the beams 7*a*, 7*b* are connected to the square shaped steel column 5 having a curved surface part 7 on its corner part.

The beam-connection member 9 is connected between the diaphragm 3*b* and the flange part 8*b* of the beam 7*b*. The beam-connection member 21 may be used instead of the beam-connection member 9.

The beam 7*b* is connected to a position decentered in the width direction of the column 5. That is, the width of the beam 7*b* is less than the width of the column 5, and the beam 7*b* is connected along an edge part of the column 5 such that the side surface of the column 5 coincides with the side surface of the beam 7*b*. A reinforcing member 30 is connected at the connection part of the beam 7*b* and the column 5 at the height corresponding to the curved surface part 7. The reinforcing member 30 is connected to the side surface of the column 5 that is a surface perpendicular to the connection direction of the beam 7*b* and is the side surface of the column 5 in the direction of decentered side of the beam 7*b*.

Figure 8:
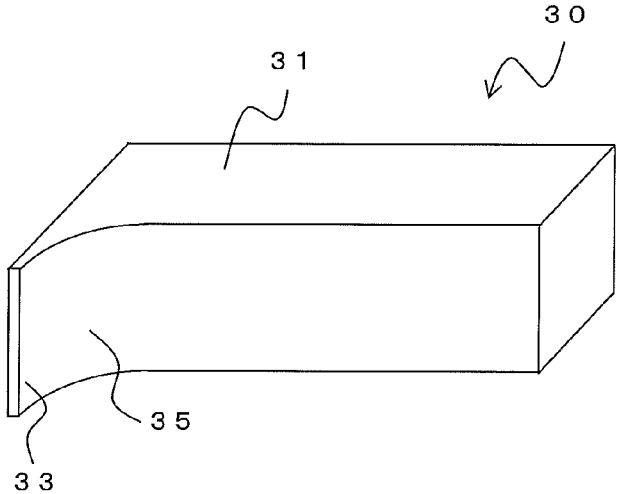
FIG. 8(*a*) and FIG. 8(*b*) illustrate a reinforcing member 30 in which FIG. 8(*a*) is a perspective view and FIG. 8(*b*) is a plan view.
Figure 8:
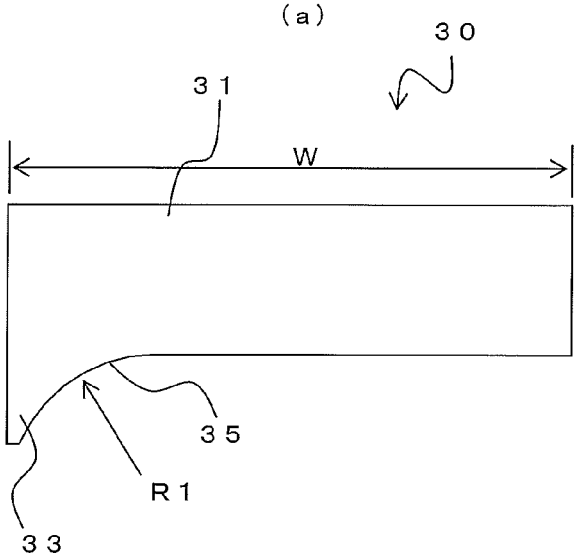

FIGS. 8(*a*) and (*b*) illustrate the reinforcing member 30 in which FIG. 8(*a*) is a perspective view and FIG. 8(*b*) is a plan view. The reinforcing member 30 is composed of an approximately rectangular parallel piped body 31 and a convex part 33. The reinforcing member 30, for example, is steel having excellent weldability. Although the body 31 is shown as a rectangular parallel piped in the drawing, a groove may be formed to the welded part which will be described below.

On an edge part of one side of the body 31 in its width direction (the left-right direction in FIG. 8(*b*)), the protruded concave part 33 is provided along the thickness direction of the body 31 (top-bottom direction in FIG. 8(*b*)). On the inner surface side of the concave part 33, an arc-shaped convex curved surface part 35 is formed. That is, the convex part 33 becomes narrower in width toward the tip and thicker toward the root part.

Figure 9:
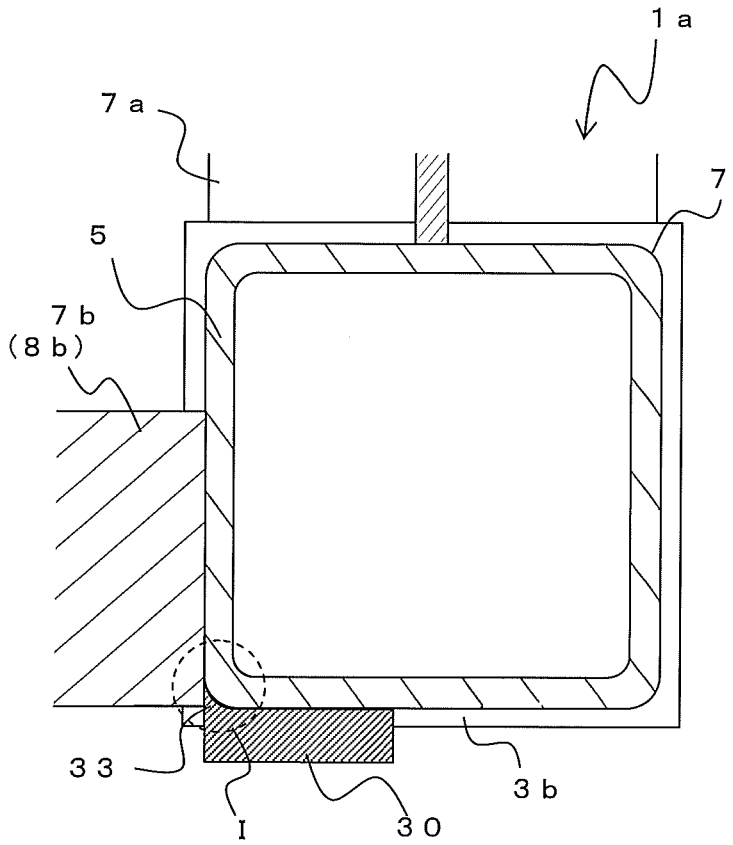
FIG. 9(*a*) is a cross sectional view illustrating the column-and-beam connection structure 1*a* of G-G line in FIG. 7.
Figure 9:
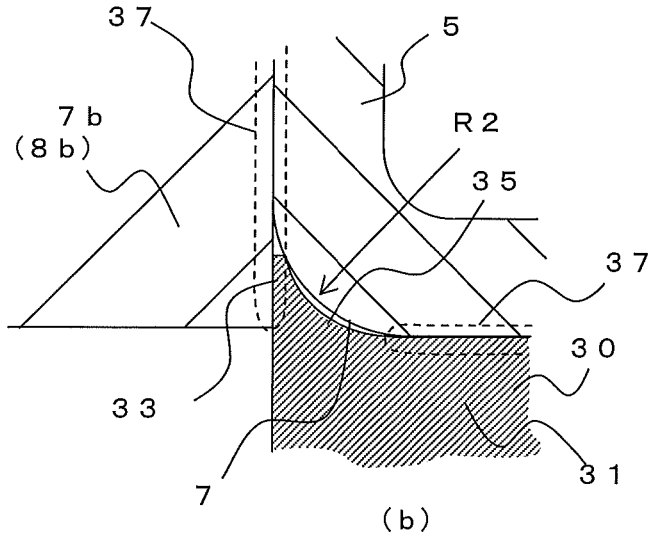

FIG. 9(*a*) is a cross-sectional view of G-G line in FIG. 7 and is a cross-sectional view of the column-and-beam connection structure 1*a* in its horizontal direction at the part of the reinforcing member 30. Also, FIG. 9(*b*) is an enlarged view of I part in FIG. 9(*a*). As mentioned above, the curved surface 7 is formed at the corner part of the column 5. Also, when the beam 7*b* is decentered in the width direction of the column 5 so that one side of the column 5 (lower side in the drawing) coincides with one side of the beam 7*b* (the flange part 8*b*), the edge part of the beam 7*b* (flange part 8*b*) is disposed so to protrude over the curved surface part 7. That is, a gap is formed between the beam 7*b* (the flange part 8*b*) and the column 5 (the curved surface part).

The body part 31 of the reinforcing member 30 is connected to the side surface of the column 5, which is perpendicular to the connecting direction of the beam 7*b* and is on the decentering direction side of the beam 7*b* (the direction in which the beam 7*b* protruding over the curved surface 7). Here, the concave part 33 is inserted in the gap between the curved surface part 7 and the beam 7*b* (the flange part 8*b*). That is, the reinforcing member 30 is positioned such that the side surface of the reinforcing member 30 coincides with the side surface (the side surface to which the beam 7*b* is connected) of the column 5. The body part 31 of the reinforcing member 30 is welded to the column 5 on the welding parts 37.

The inner surface side of the convex part 33 is disposed so to oppose the curved surface part 7. Here, the concave curved surface part 35 on the inner surface side of the convex part 33 has a shape corresponding to the curved surface 7, and its radius of curvature R1 (FIG. 8(*b*)) is set slightly smaller than the radius of curvature R2 (FIG. 9(*b*)) of the curved surface part 7 of the column 5. This is because if R1 is larger than R2, the tip part of the convex part 33 does not make contact with the column 5. The convex part 33 and the beam 7*b*, as well as the beam 7*b* and the column 5 are welded with the welded part 37. That is, the reinforcing member 30, the column 5, and the beam 7*b* are welded respectively. A small gap between the concave curved surface part 35 and the curved surface 7 may be formed. Also, a tapered part and the like showing a welding part may be formed on the body part 31 and the like to indicate an appropriate welding margin for welding the column 5 and the beam 7*b*.

The width W of the reinforcing member 30 (FIG. 8(*b*)) is half or less than the overall width of the column 5. This makes it possible to connect a pair of the reinforcing member 30 on a same side surface at a same height. For example, in FIG. 9(*a*), if the beam 7*b* is to be connected symmetrically to the right side of the column 5 similarly as on the left side, it is required to connect a pair of reinforcing member 30 facing toward both left and right directions. In this case, if the width W of the reinforcing member 30 is half or less than the overall width of the column 5, the reinforcing members do not interfere with each other.

As described above, according to the second embodiment, it is possible to transmit stress from the beam 7*b* to the column 5 efficiently even in a case in which the beam 7*b* is connected to the column 5 that has the curved surface part 7 on the corner part, and a part of the beam 7*b* protrudes over the curved surface part 7 of the column 5. Therefore, if the width of the beam 7*b* is smaller than the width of the column 5, and the beam 7*b* is disposed decentered to the column 5 in its width direction, stress transmission between the beam 7*b* and the column 5 can be secured without using through-diaphragms.

Also, making the radius of curvature R1 of the concave curved surface part 35 on the inner side of the convex part 33 smaller than the radius of curvature of the curved surface part 7 of the column 5 prevents the tip part of the convex part 33 from rising from the connected surface. Also, by making the width W of the reinforcing member 30 half or less than the overall width of the column 5, no interference occurs when the two reinforcing members 30 are used at the same time and arranged side by side at an approximately same height.

Although, the reinforcing member 30 has the concave curved surface part 35 on the inner surface of the convex part 33, the part may not necessarily be a curved surface. For example, as shown in a reinforcing member 30*a* illustrated in FIG. 10(*a*), the inner surface of the convex part 33 may be a concave surface part 35*a* in which a plurality of straight lines are connected to form the inner surface of the convex part 33. In this case, it is necessary to ensure that the concave surface part 35*a* does not interfere with the curved surface part 7 when the reinforcing member 30*a* is connected to the column 5.

Figure 10:
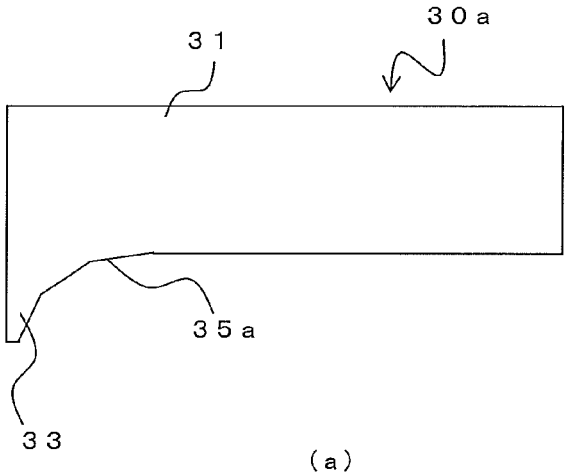
FIG. 10(*a*) and FIG. 10(*b*) illustrate reinforcing members 30*a* and 30*b*.
Figure 10:
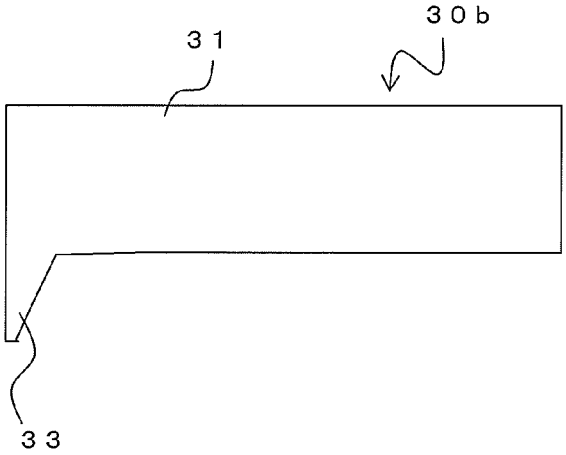

Also, as shown in a reinforcing member 30*b* illustrated in FIG. 10(*b*), the inner surface of the convex part 33 may be a tapered form. In this case, it is also necessary to ensure that the tapered part does not interfere with the curved surface part 7 when the reinforcing member 30*b* is connected to the column 5.

Although the embodiments of the present invention have been described referring to the attached drawings, the technical scope of the present invention is not limited to the embodiments described above. It is obvious that persons skilled in the art can think out various examples of changes or modifications within the scope of the technical idea disclosed in the claims, and it will be understood that they naturally belong to the technical scope of the present invention.

EXPLANATION OF NUMERALS

1, 1*a*, 20 . . . connection structure of beam and column
3*a*, 3*b* . . . diaphragm
5 . . . column
7 . . . curved surface part
7*a*, 7*b* . . . beam
8*a*, 8*b* . . . flange part
9, 21 . . . beam-connection member
11, 12 . . . notch
13 . . . tapered part
14, 24 . . . column-connection surface
15 . . . depression
16, 26 . . . beam-mounting surface
17 . . . rib
19 . . . welded part
23 . . . mark-off line
30, 30*a*, 30*b* . . . reinforcing member
31 . . . body part
33 . . . convex part
35 . . . concave curved surface part
35*a* . . . concave surface part
37 . . . welded part

What is claimed is:

1. A beam-and-column connection structure, comprising:

a connection member having a column-connection surface connected to the column, a beam-mounting surface which is a surface approximately perpendicular to the column-connection surface, and a notch formed on the column-connection surface along the width direction of the body to avoid interference with a diaphragm;

a pair of diaphragms formed on the column;

a first beam of which flange parts are connected to the upper and the lower diaphragms respectively; and a second beam that has a different height to the first beam and is connected to the column in a different direction to the first beam; wherein, a flange part of the second beam is connected to one of the diaphragms;

the column-connection surface of the connection member is connected to the peripheral surface of the column between the other flange part of the second beam and the other diaphragm;

the thickness of the connection member at an intersection part of the extended part of the diaphragm and the connection member, in which the interference is avoided at the notch, is provided to be larger than the thickness of the column; and stress is transmitted between the other flange part of the second beam and the other diaphragm via the connection member.

2. The beam-and-column connection structure according to claim 1, wherein:

a depression is provided on the column-connection surface, the depth of the depression being half or more of the body thickness of the connection member; and the thickness of the connection member at an intersection part of the extended part of the diaphragm and the connection member, in which the interference is avoided at the notch, is provided to be larger than the thickness of the column.

3. The beam-and-column connection structure according to claim 2, wherein:

a rib is formed on the depression in its width direction.

4. The beam-and column connection structure according to claim 1, wherein:

the lower surface of the other flange surface of the second beam is in contact with the beam-mounting surface of the connection member.

5. The beam-and-column connection structure according to claim 1, further comprising:

a reinforcing member having a convex part protruding along the thickness direction of the edge part of the body in a direction that is perpendicular to its width direction; wherein, the column has an approximately rectangular shaped cross-sectional outline and a curved surface part at a corner part;

at least one of the edge part of the second beam in its width direction protrudes over the curved surface part of the column;

the reinforcing member is connected to the column and the second beam with the convex part being inserted to a gap between the curved surface part and the other flange part of the second beam at the height of the other flange part of the second beam; and stress is transmitted between the other flange part of the second beam and the column via the reinforcing member.

6. The beam-and-column connection structure according to claim 5, wherein:

the inner surface of the convex part of the reinforcing member is a concave curved surface part which approximately corresponds to the shape of the curved surface, and the radius of curvature of the concave surface part is less than the radius of curvature of the curved surface part.

7. The beam-and-column connection structure according to claim 5, wherein:

the width of the second beam is less than the width of the column; and the second beam is connected to the column decentered in its width direction.

8. The beam-and-column connection structure according to claim 5, wherein:

the length of the reinforcing member is half or less of the width of the column.

* * * * *